US006419459B1

(12) United States Patent
Sibbing

(10) Patent No.: US 6,419,459 B1
(45) Date of Patent: Jul. 16, 2002

(54) PUMP FLUID CYLINDER MOUNTING ASSEMBLY

(75) Inventor: Ronald Norbert Sibbing, Quincy, IL (US)

(73) Assignee: Gardner Denver, Inc., Quincy, IL (US)

( * ) Notice: Subject to any disclaimer, the term of this patent is extended or adjusted under 35 U.S.C. 154(b) by 89 days.

(21) Appl. No.: 09/677,216

(22) Filed: Oct. 2, 2000

(51) Int. Cl.[7] ..... F04B 17/00

(52) U.S. Cl. ..... 417/360; 403/374.4; 92/146; 92/147; 92/161; 29/888.044

(58) Field of Search ..... 417/360; 403/374.4, 403/374.3, 370; 92/146, 147, 161

(56) References Cited

U.S. PATENT DOCUMENTS 4,123,201 A * 10/1978 Andriulis ..... 417/204
4,552,180 A * 11/1985 Mayer ..... 137/625.66
4,704,780 A * 11/1987 Moffett ..... 29/252
5,232,304 A * 8/1993 Huang ..... 403/374
5,529,389 A * 6/1996 Sekiguchi ..... 303/116.4
5,836,078 A * 11/1998 Aiken et al. ..... 29/898.08

* cited by examiner

*Primary Examiner*—Charles G. Freay
*Assistant Examiner*—W Rodriguez
(74) *Attorney, Agent, or Firm*—Lee, Mann, Smith, McWilliams, Sweeney & Ohlson

(57) ABSTRACT

A mounting assembly for mounting a pump to a fluid cylinder comprising a tie rod threaded at one end and providing a second end drivingly engageable with a sleeve-like threaded connection for clamping attachment directly into the cylinder block by the direct thread engagement of the connector internally of the cylinder block. The invention eliminates the requirement of machining a fluid cylinder block to provide engageable flanges and form nut pockets, thereby minimizing fabrication time and costs, while increasing strength, stability and alignment accuracy between pump pony rods and plunger assemblies of fluid cylinders generally of the type used for high pressure industrial applications.

16 Claims, 5 Drawing Sheets

PUMP FLUID CYLINDER MOUNTING ASSEMBLY

BACKGROUND OF THE INVENTION

The invention generally relates to multipurpose pumps useful for various applications, such as oil well servicing, oil well stimulation, water blasting, and various industrial uses. The invention is more specifically directed to the mounting of a fluid cylinder to the power end assembly of a pump.

The prior art techniques for mounting a fluid cylinder to a pump require the machining of flanges in the fluid cylinder block in order to create nut pockets for affixing nuts to the threaded ends of stay rods passing through the flanges. The creation of these flanges requires extensive machining time and further demands the accurate alignment of through bores cut through the flanges for passages of stay rods to be affixed thereto and aligned axially with corresponding bores in the pump frame. At the opposite ends of the stay rods, threaded portions threadingly engage the threaded bores of the pump frame.

Typically, pumps of the kind primarily envisioned for the present invention are high pressure devices, often reaching pressures in the range of 10–20,000 psi (703 $Kg/cm^2$–1406 $Kg/cm^2$). Such are often used as oil stimulation pumps well known in the petroleum industry. In these arrangements, pony rods driven by crank shaft drives within the pump's power end assembly are drivingly cooperative with reciprocating plungers communicating within the fluid cylinder for providing high pressure fluid discharge. High stresses can be created with pumps operating normally in the range of 350–2000 BHP for driving plungers that are typically from about 4" to 8" in diameter.

Normally, each pony rod and an associated plunger have four stay rod assemblies therearound for interconnecting the frame of the pump to machined flanged portions of the fluid cylinder block. The machining required to create the flanged portions inherently eliminates valuable stabilizing mass and strength from the block of steel forming the fluid cylinder. Zones of weakness are created by this procedure. Machining the steel block also requires a significant amount of labor cost and time. Built in to the machining process is potential stay rod alignment inaccuracy by cutting bores in the flanges for accommodating the stay rods and forming nut pockets for fastening the rods to the flanges. This prior art method can also affect the alignment of the pony rods and plungers. With the high pressures developed by the pumps and resultant dynamic forces, coupled with the concurrent rapid reciprocation times of the pony rods, even slight misalignments can cause early machine part wear, breakdowns, loss of power, and the requirement to check and retighten connections.

It is therefore a goal of the present invention to eliminate the expensive and strength reducing process of forming flanges and nut pockets in a fluid cylinder block. Because of the special performance requirements of high pressure pumps, the fluid cylinder blocks are not cast but are forged from special heat treated steels. Accordingly, it is an adjunct goal of the invention to maintain the full stabilizing mass of the forged fluid cylinder block for retaining strength, eliminating weakened zones, and maximizing pump-to-fluid cylinder pony rod/plunger alignments.

It is a concomitant object of the invention to eliminate the prior art techniques of creating weakened flange sections which have been required to be made in order to provide through-bores necessary to connect nuts to the stay rods extending therethrough from the pump frame.

It is an allied objective of the invention to provide for a direct attachment to the fluid cylinder block internally of the steel mass forming the fluid cylinder block.

SUMMARY OF THE INVENTION

The invention replaces the bolted stay rod technique of the prior art and provides a unique tie rod and exteriorly threaded connector assembly to clampingly embed the tie rods directly into the steel block forming the fluid cylinder and co-axially aligning them with corresponding engageable bores in the pump frame.

A plurality of tie rods are provided with either a short or long sleeve-like threaded connector for attachment to the fluid cylinder block. The short and long connectors facilitate a captive and anchored clamping of shouldered heads of the tie rods within at least partially threaded bores in the fluid cylinder block. Usually with multiple pump pony rods, each pony rod is associated with a fluid cylinder plunger and four tie rods and connectors. The short and long connectors preferably are arranged, respectively, at upper and lower adjacent tie rods to permit for the direct passage of a tightening wrench to reach and facilely engage a hex head of a connector at the correct 90° relation for accurate threading rotation for clamping the tie rod to the fluid cylinder. The opposite end of the tie rod is threaded and forms a shoulder relief portion for accommodating a pump frame spacer, which spacer is pressed against the pump frame as the threaded end of the tie rod threadingly engages a threaded bore in the pump frame. A grippable surface of the tie rod is created along the tie rod, such as by knurling, to facilitate the sure grip of a pipe wrench for tightening to the pump frame. Optionally, the shouldered head of the tie rod is provided with an axial hex bore, which facilitates the initial starting of the threaded connection at the other end to the pump frame, such as by means of a drill and bit spinning the tie rod, leaving only the final tightening of the threaded engagement to the pump frame by, for example, a torque wrench gripping the knurled surface.

The shouldered head of the tie rod has an abuttable annular shoulder surface forcefully contacted by a short or long connector as the connector is tightened into a fluid cylinder threaded bore, thereby inserting and clamping the shouldered head into the bore of the fluid cylinder. The leading, or terminal, end of the shouldered head is preferably provided with a circumferential chamfer, which bottoms out generally at the drill point bottom wall of the threaded bore.

In a standard configuration for an oil well stimulation pump, three pony rods driven by the pump power end assembly are drivingly associated with three fluid cylinder plungers. The invention provides a method for the quick connection of twelve tie rods (four tie rods around each plunger), having sleeve-like short or long connectors slidingly placed thereon, which tie rods are subsequently rotated by means of a power drill, or the like, engaging the hex end bores of the tie rods and spinning them for preliminary attachment of the opposite threaded ends to twelve threaded bores in the pump frame. The tie rods are then finally tightened by means of a torque wrench or the like. The fluid cylinder is then brought adjacent to the power end assembly of the pump having the attached tie rods, and the tie rod shouldered heads are inserted into twelve threaded bores in the fluid cylinder block. The connectors are then wrench-tightened at hex bolt heads thereof to force the connectors against the shouldered heads and embeddingly clamp the tie rods inside the bores to thereby securely mount the fluid cylinder on the pump frame.

DETAILED DESCRIPTION OF THE INVENTION

Figure 1:
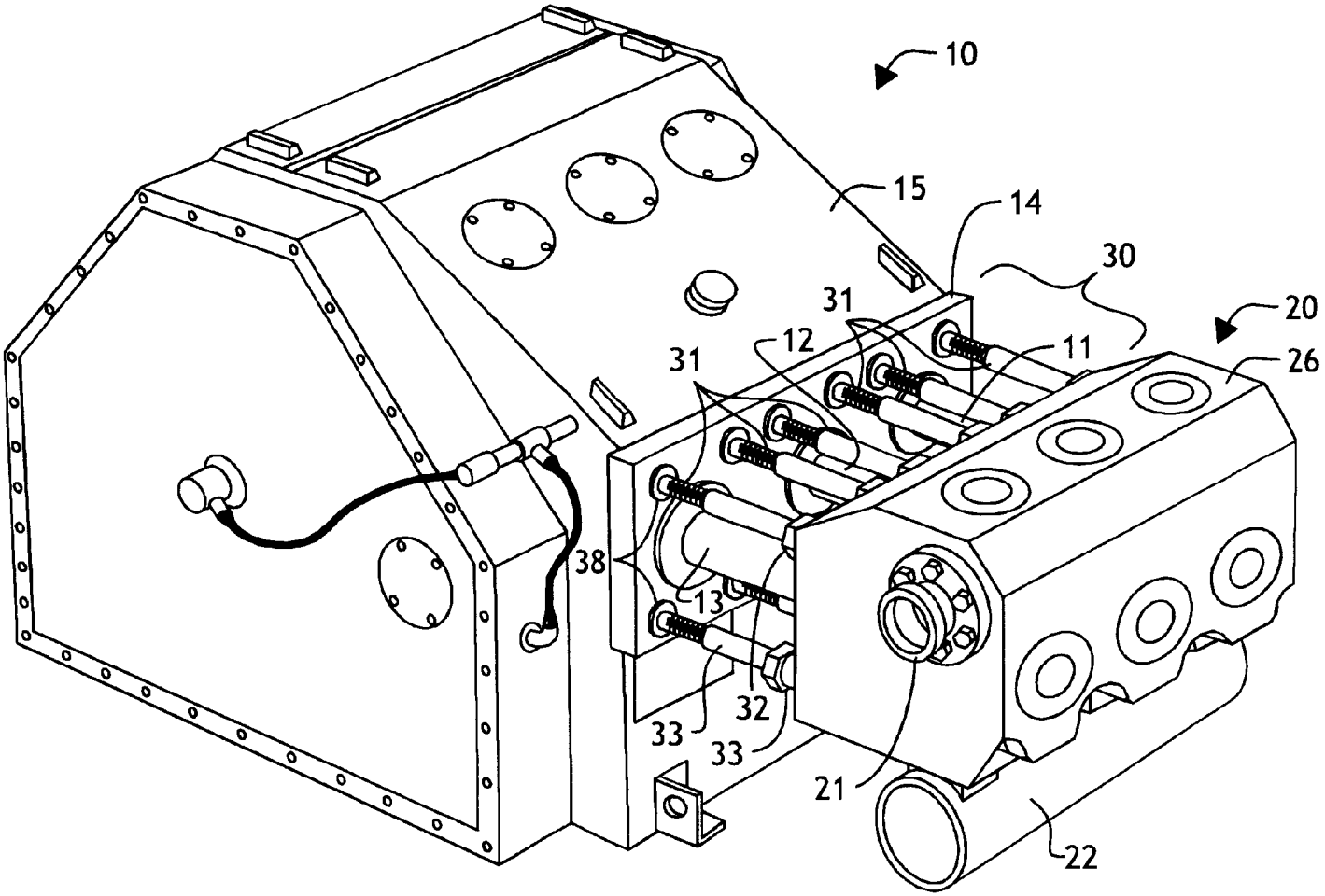
FIG. 1 is a perspective view of a power end assembly of a pump and a fluid cylinder connected thereto by means of the mounting assembly of the present invention.

In reference to the attached figures, like reference numerals are used to refer to the same elements throughout.

Figure 2:
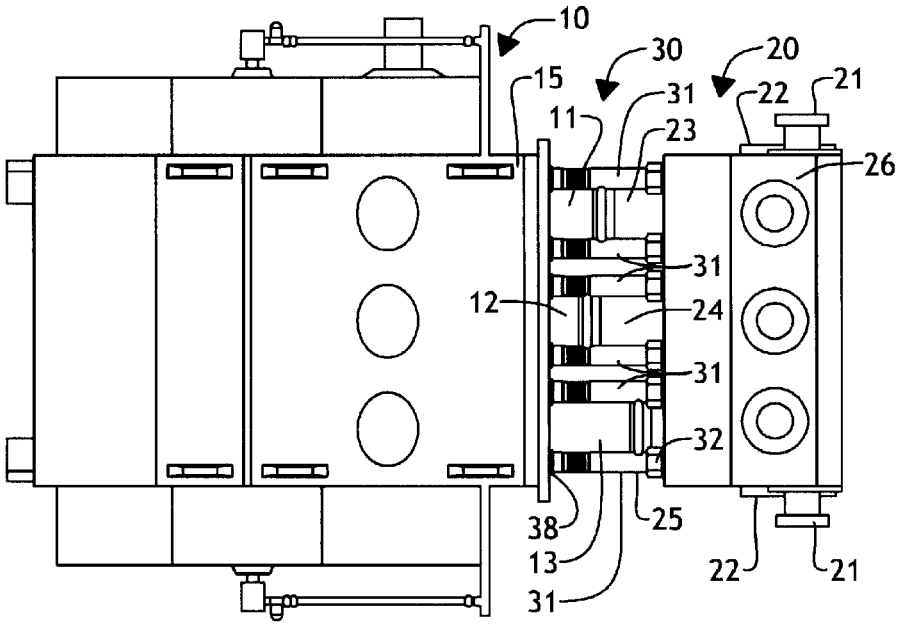
FIG. 2 is a top plan view of the pump and fluid cylinder of FIG. 1.
Figure 3:
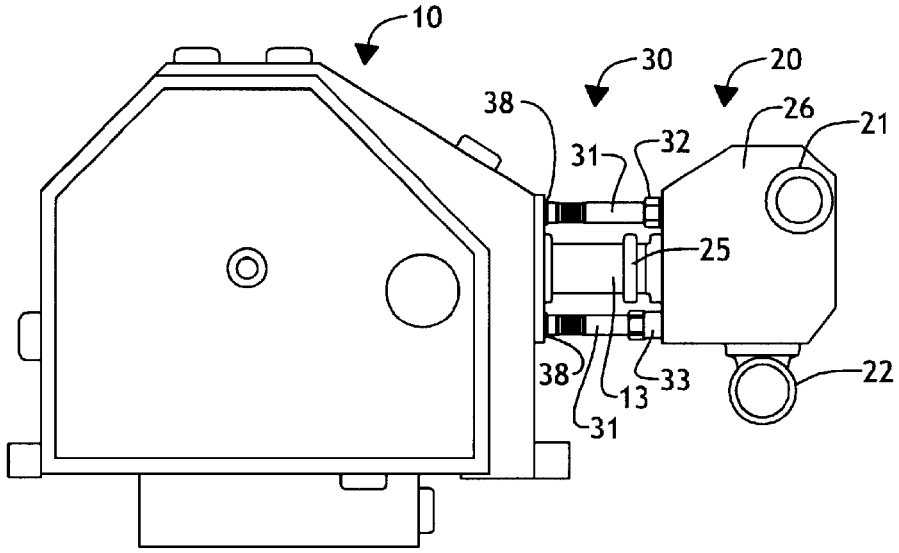
FIG. 3 is a front elevational view of the pump and fluid cylinder of FIG. 1.

In reference to FIGS. 1–3, it will be seen that the invention is directed to the mounting of a pump 10 to a fluid cylinder 20 of generally known constructions. One commercial pump that may be used in practicing the invention is a Series OPI 2000 well stimulation pump manufactured and sold by Gardner Denver, Inc. An example of a fluid cylinder also useful in practicing the invention is a 1515 GPM cylinder block having a one-piece design, also sold by the same manufacturer. The invention comprises a mounting assembly 30 therebetween. It will be observed that in the illustrative embodiment, the pump 10, which is also referred to in the industry as the power end assembly, drives three pony rods 11, 12 and 13, which operably communicate with the fluid cylinder 20. The fluid cylinder 20 is also referred to in the industry as the fluid end assembly. The fluid cylinder 20 has discharge outlets 21 and a suction manifold 22. The fluid cylinder 20 in the exemplary embodiment is made of a special forged heat-treated steel alloy, which meets ASTM standard No. 4330. Forged cylinder blocks are normally required because of the pressures developed in these industrial type pumps that typically can range from about 10,000 psi (703 $Kg/cm^2$) to over 20,000 psi (1406 $Kg/cm^2$). The fluid cylinder 20 has three plungers 23, 24 and 25, which are driven by the pony rods 11, 12 and 13, respectively. The pump 10 includes crank shaft and cross-head assemblies well-known in the industry for reciprocally driving the pony rods. Horsepower ratings of such high pressure pumps are typically in the range of from about 350 BHP to about 2000 BHP. In operation, considerable force is thus exerted whereby vibratory effects should be minimized to maintain the alignment of the pump pony rods 11–13 with the fluid cylinder plungers 23–25 and keep mounting assembly connections tight.

Figure 4:
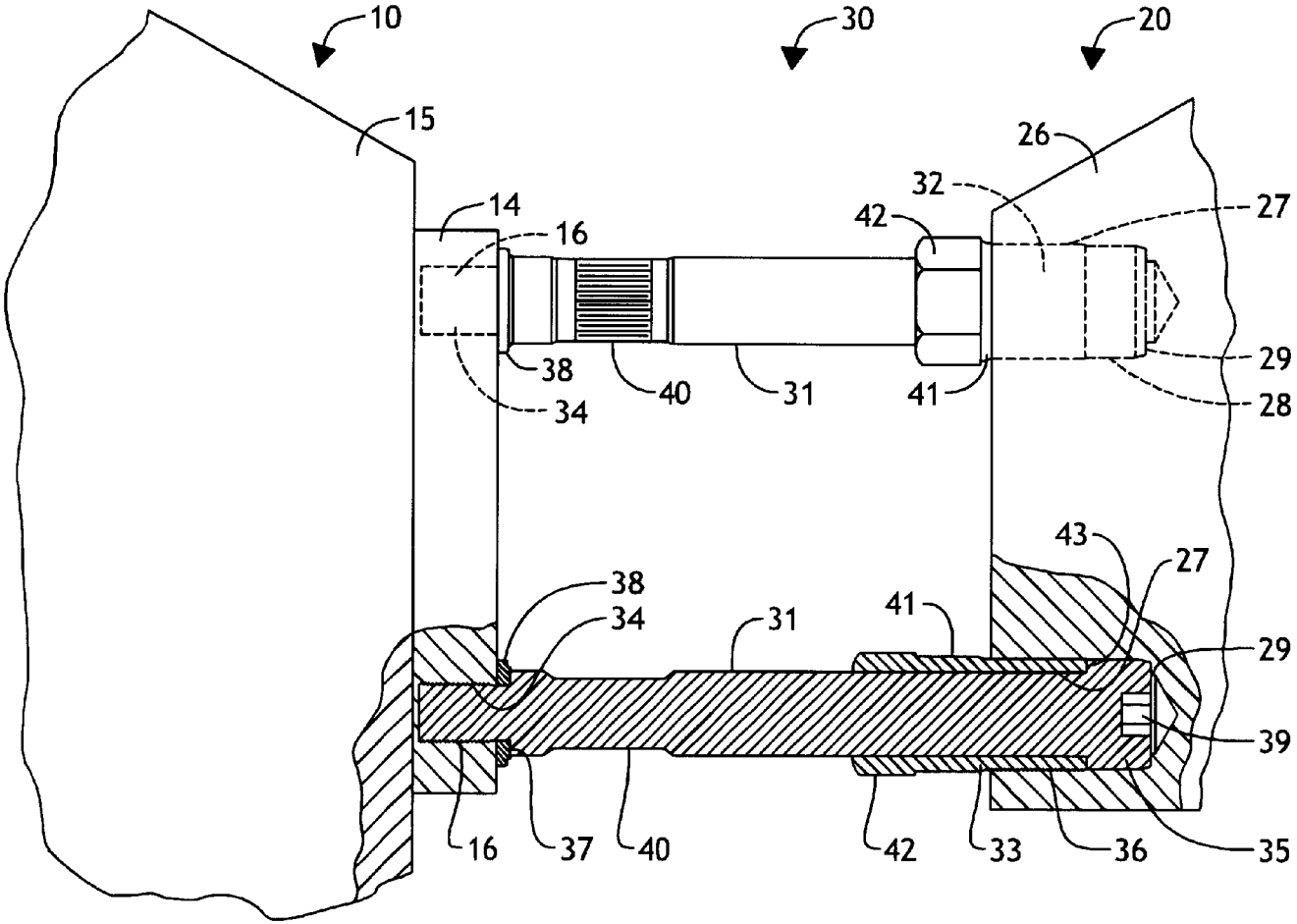
FIG. 4 is a vertical cross-sectional view taken through two vertically adjacent tie rod assemblies of the present invention and showing the connection of the fluid cylinder to the power end assembly of the pump as in FIG. 1.
Figure 4A:
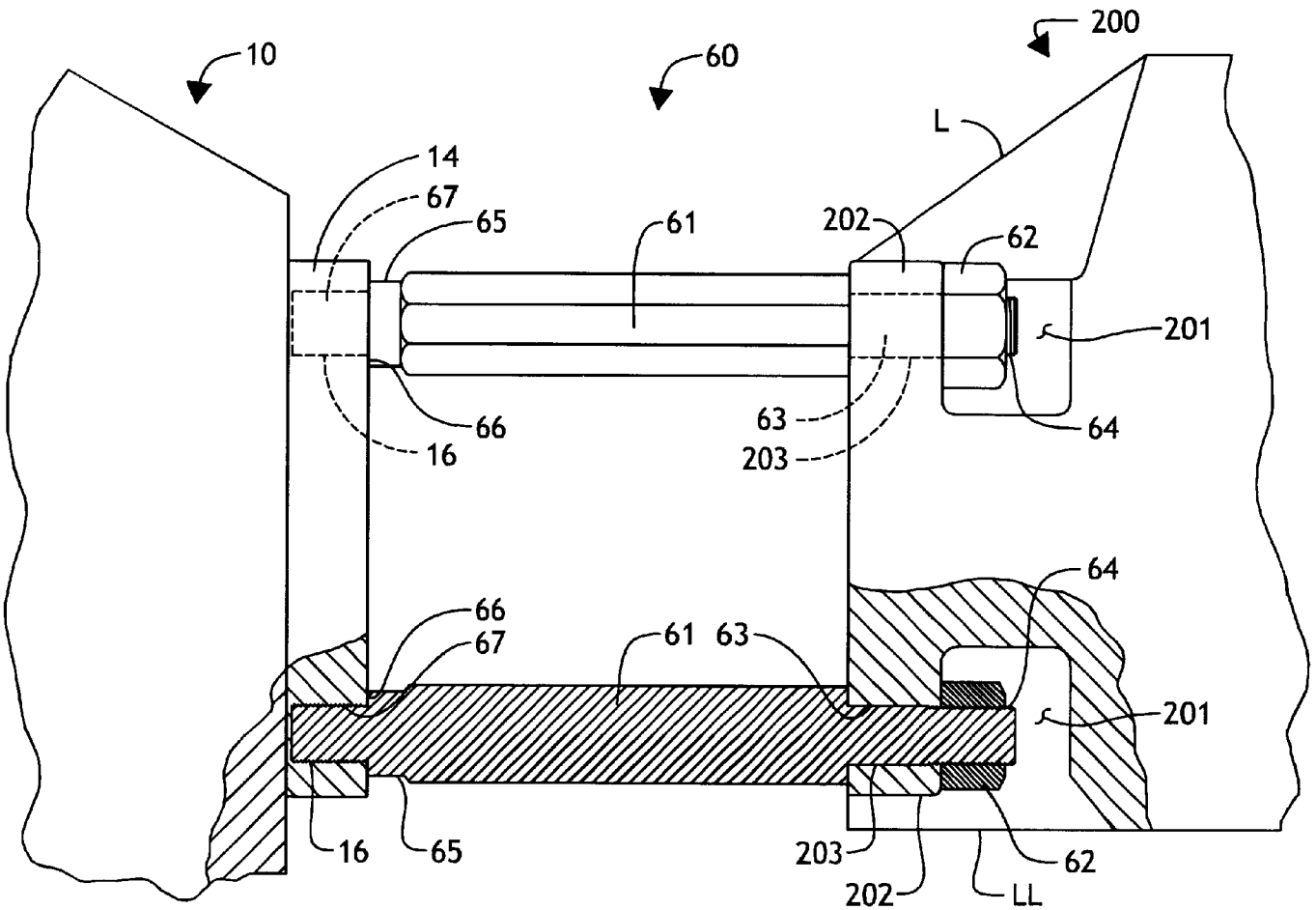
Fig. 4a PRIOR ART
FIG. 4*a* is a vertical cross-sectional view like FIG. 4 but showing a prior art stay rod mounting assembly.

With reference now to FIGS. 4 and 4*a,* the inventive mounting assembly 30 and prior art assembly 60 will be seen in greater detail. The mounting assembly 30 joins a fluid cylinder block 26 of the fluid cylinder 20 to a plate 14 of pump housing 15 of the pump 10.

The mounting assembly 30 comprises a plurality of tie rods 31 each associated with a sleeve-like hollow connector 32 or 33. Said tie rods 31 each having a threaded end 34 opposite a second end having a shouldered head 35, preferably ending in a circumferential chamfer. In the disclosed embodiment, each of the pony rods 11–13 and plungers 23–25 are associated with four tie rods, whereby twelve tie rods 31 join the pump 10 to the fluid cylinder 20, as shown in FIGS. 1–3. The connections of the ties rods 31 to the plate 14 are made possible by machining complementary threaded bores 16 into the plate 14 to be thread engageable with the threaded end 34 of each tie rod 31. At the other side, the fluid cylinder block 26 is machined to have at least partially threaded bores 27 engageable by threaded shafts 36 of the connectors 32 and 33. The bores 27 in the preferred embodiment have extending non-threaded portions 28, which need not be threaded as they are for the clamping receipt therein of the shouldered heads 35 of the tie rods 31. The shouldered heads 35 are not rotationally thread-engaged but are longitudinally forced bore-inward. The bores 26 are machine drilled, threaded and bored, and terminate in drill point bottom walls 29 against which the shouldered heads 35 abut.

The threaded ends 34 of the tie rods 31 are cut to have a smaller diameter than the adjacent major diameter of the tie rods 31 thereby forming annular spacer shoulders 37 for accommodating washer-like spacers 38, which abut against, and distribute tightening forces onto, the plate 14.

The threading attachment of the tie rods 31 to the plate 14 is initially achieved by means of optional hex bores 39 that are axially machined into the leading ends of the shouldered heads 35. The hex bores 39 facilitate a time-saving initial starting of the threading engagement of the tie rods 31 into the plate 14 by means of using a drill with a complementary hex bit for engaging the hex bores 39 to screw the threaded ends 34 into the bores 16. To accomplish complete tightening to a prescribed torque level, the tie rods 31 are further provided with knurling 40, which offer a grippable surface for applying a torque wrench to finally tighten the connection between the tie rods 31 and the plate 14.

It will be observed from FIG. 4 that the connectors 32 are short connectors and connectors 33 are longer by virtue of having a longer shank portion 41 between a bolt-like hex head 42 and the threading 36. By providing vertically adjacent short and long connectors, a wrench can be introduced between the pump 10 and the fluid cylinder 20, so that each vertically adjacent pair of long and short connectors can be reached by the mechanic to be tightened into the fluid cylinder 20. Because the longer connectors hex heads 42 project further from the fluid cylinder 20, the shorter and longer connector hex heads 42 are tightenable in different parallel vertical planes, thus providing clearance for a wrench to correctly approach them all at 90° to the axes of the connectors 32 and 33.

With reference to FIG. 4*a,* a prior art mounting assembly 60 is shown for comparison. In this prior art technique, the assembly 60 is provided with a plurality of hex-shaped stay rods 61, which are connected by means of nuts 62 to a fluid cylinder block 200. In this common prior art technique, the fluid cylinder block 200 is machined to provide nut pockets 201 and flanges 202, which flanges are bored therethrough at 203 for the receipt therein of a smooth shaft 63 of the stay rods 61. The stay rods 61 terminate in threaded ends 64 for engagement by the nuts 62. The creation of the nut pockets 201 results in weakened zones in the flanges 202 adjacent to the connections of the stay rods 61. The machining also eliminates considerable mass from the steel cylinder block, which can lead to fatigue cracking due to pressure pulsations. The phantom lines L and LL show the original block shape and indicate the amount of steel machined from the fluid cylinder block 200, without which machining the fluid cylinder block 200 would have the construction and mass of the fluid cylinder block 20. This may amount to hundreds of pounds of lost mass. For a 1515 GPM fluid cylinder, this can amount to a loss of about 400 pounds.

Because of clearance inherently required to insert the shafts 63 into the bores 203, axial misalignments can occur between the pump pony rods and fluid cylinder plungers. At the other end of the stay rods 61, lesser diameter stay rod shafts 65 terminate in abutment shoulders 66 at threaded end stubs 67 that are thread engageable with bores 16' made in a plate 14' of a pump 10'. The pump 10' and plate 14' being substantially identical to the pump 10 and plate 14 of the illustrative embodiment shown in FIGS. 1–4.

In achieving a more secure mounting than the prior art, the connection of the tie rods 31 to the fluid cylinder block 20 by means of the connectors 32 and 33, and the clamping of the shouldered heads 35 within the bores 27 to abut against the bottom walls 29, establish a direct embedment internally of the fluid cylinder block mass. This provides a very stable unweakened joinder contrary to the external bolted connection of stay rods 61 passed through bores 203 in a flange 202 of the fluid cylinder 200 shown in FIG. 4a. The connectors 32, 33 of the invention threadably clamp the tie rods inside the mass of the cylinder block versus the prior art technique of externally bolting them onto a flange. Additionally, the provisions of a grippable knurling surface 40 for tightening the threaded end of the tie rods and pressing the shoulders 37 against spacers 38 to create an even abutting force against the plate 14 achieve stronger connections over the prior art.

Previously known mounting assemblies have not provided means to facilitate a fast efficient preliminary connection of stay rods to the pump plates. In the present invention, the tie rods 31 having the optional hex bores 39 greatly improve attachment efficiency, which is highly desirable when connections, for example, in an oil field, must be made under varying weather conditions, uneven terrain and other deleterious environmental conditions.

Figure 5:
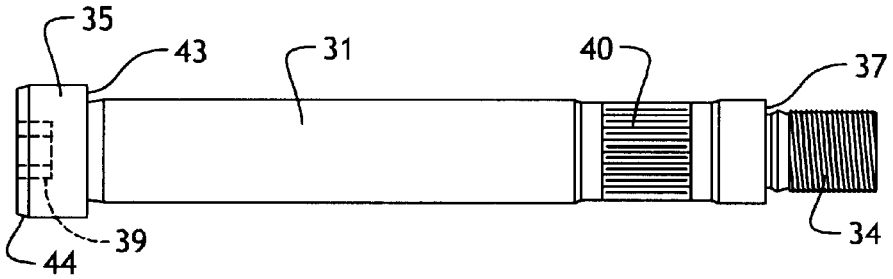
FIG. 5 is a plan view of the tie rod of the mounting assembly.

With reference to FIGS. 5–12, details of the tie rod 31, connectors 32, 33 and spacer 38 are shown. FIG. 5 illustrates the tie rod 31 having the smaller diameter threaded end 34 joining the tie rod 31 at a shoulder 37, which forms an annular seat for the spacer 38 shown in FIGS. 11–12. The knurling 40 allows for grippable attachment of a wrench to tighten threading 34 into a pump plate threaded bore.

Figure 6:
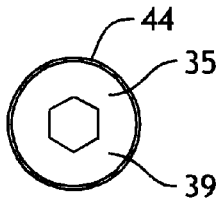
FIG. 6 is a end view looking at the left end of the tie rod of FIG. 5.
Figure 7:
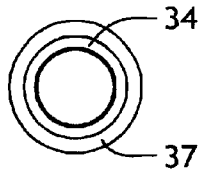
FIG. 7 is an end view looking at the right end of the tie rod of FIG. 5.

At the opposite end of the tie rod 31, the hex bore 39 is machined into the end face of the shouldered head 35. An end view of the hex bore 39 is shown in FIG. 6 facilitating the insertion of a drill bit for the preliminary threading engagement of the threaded end 34 into a threaded bore 16 of the plate 14. Other polygonal, geometric, or non-geometrically shaped bores could also be formed for driving engagement by a drill bit shaped to engage the particular bore configuration.

The shouldered head 35 provides a shoulder 43 for the short or long connector 32 or 33 to press against when the threads 36 are screwed into threaded bore 27 for clamping a chamferred end 44 of the shouldered head 35 into the non-threaded portion 28 of the bore 27 bored into the fluid cylinder block 23. The chamfered end 44 is driven against the drill point bottom wall 29 of the bore 27.

Figure 8:
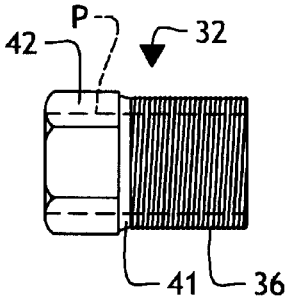
FIG. 8 is a plan view of a short connector for connecting a tie rod to a fluid cylinder.
Figure 9:
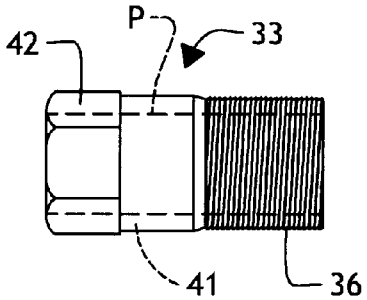
FIG. 9 is a plan view of a long connector for connecting a tie rod to a fluid cylinder.
Figure 10:
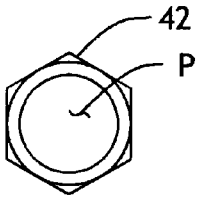
FIG. 10 is an end view showing the identical hex bolt head of the short and long connectors of FIGS. 8 and 9.
Figure 11:
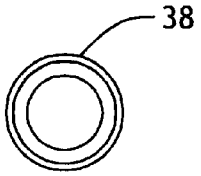
FIG. 11 is a spacer mountable at a recessed spacer shoulder of the tie rod located substantially adjacent the threaded end of the tie rod as shown in FIG. 5; and, FIG. 12 is a side view of the spacer of FIG. 11.
Figure 12:
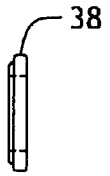

FIG. 8 illustrates a short connector 32 having a hex head 42, shank 41, and threading 36. In FIG. 9, a long connector 33 is shown having the identical hex head 42 and threading 36 but having a longer shank 41 extending between the threading and the hex head. The connector 33 is made longer by an amount that allows for wrench clearance within the space between the pump 10 and the fluid cylinder assembly 20 for the purpose of correctly gripping all the hex heads 42 of the connectors 32 and 33 at 90° to the long axis of the connectors. As shown in dashed lines, the connectors 32, 33 are hollow and sleeve-like with an internal passageway P sized to slide over the tie rods 31. FIG. 10 is an end view of the hex heads 42 and having a typical bolt configuration.

In the disclosed embodiment the tie rods 31 are comprised of a standard ASTM 4340 heat treated steel alloy. For the example disclosed, when utilizing a 2000 BHP pump and 1515 GPM fluid cylinder, the tie rods 31 have a length of about 19 inches and nominal diameter of about 2¼ inches. These dimensions will vary with pump sizes, numbers of plungers, fluid cylinder capacities, fluid pressures, and the like, as would be understood by one skilled in the art. The illustrative connectors 32 and 33 are made of stainless steel and the spacers 38 are made of a heat treated ASTM 4140 steel alloy. Equivalent materials are useable for practicing the invention.

The foregoing is a description of a preferred embodiment of the invention but it will be understood that the claims appended hereto are not limited thereto and have a broad range of equivalents thereof.

What is claimed is:

1. A mounting assembly for connecting a pump to a fluid cylinder comprising:

a plurality of tie rods extending between and mechanically affixed to a pump frame and a fluid cylinder block;

correspondingly axially aligned threaded bores in said pump frame and fluid cylinder block, one said tie rod extending along each axis;

a sleeve-like threaded connector arranged at one end of each said tie rod having external threading threadably engaged with one of said bores of said fluid cylinder block;

said tie rods including shouldered heads abuttably engaged by said sleeve-like connectors within said bores of said fluid cylinder block;

said tie rods having opposites ends having threads being threadably engaged in said bores of said pump frame and further having a shoulder faced toward said pump frame;

said tie rods extending internally of said fluid cylinder block and being clamped therein by said connectors.

2. The mounting assembly of claim 1 wherein at least one of said tie rods being clampingly engaged to said fluid cylinder block by a connector having a first length and at least one of said tie rods being clampingly engaged to said fluid cylinder block by a connector having a second longer length.

3. The mounting assembly as claimed in claim 1 wherein the external threading of said connectors threadably engage threaded first portions of said fluid cylinder block bores and wherein said shouldered heads of said tie rods extending therefrom through unthreaded second portions of the bores to bottom walls of said bores.

4. The mounting assembly as claimed in claim 1 wherein said shouldered heads of said tie rods each having an axial bore for receiving a rotatable driving bit therein.

5. The mounting assembly as claimed in claim 1 wherein said tie rods threaded ends threadably engage the threaded bores of said pump frame for substantially the full depth of the bores.

6. The mounting assembly as claimed in claim 1 wherein the shoulders at said opposite ends are recessed radially inwardly of said tie rod.

7. The mounting assembly as claimed in claim 1 wherein said shouldered heads include shoulders extending radially outwardly of said tie rod.

8. The mounting assembly as claimed in claim 1 wherein said tie rods include a grippable circumferential portion spaced closer to the pump frame than to the fluid cylinder block.

9. A method of attaching a fluid cylinder to a pump comprising the steps of:

(a) boring threaded first bores directly into a fluid cylinder block;

(b) boring a like number of axially aligning threaded second bores having a smaller diameter than said first bores into a pump frame;

(c) placing externally threaded sleeve-like connectors over first ends of a plurality of tie rods;

(d) placing a spacer member onto said tie rods adjacent opposite threaded ends of said tie rods;

(e) thread engaging said opposite threaded ends of said tie rod in said second bores of said pump frame;

(f) inserting the said first ends of said tie rods into the axially aligning first bores in said fluid cylinder block; and, (g) turning said sleeve-like connectors to threadably engage the threaded first bores in said fluid cylinder block and urging block-inwardly said tie rods to abuttingly clamp against bottom walls of said first bores of said fluid cylinder block.

10. The method as in claim 9 wherein the thread engagement of the opposite threaded ends of the tie rods in the pump frame bores includes a first step of drivingly engaging the first ends of the tie rods to start the threadable engagement in the pump frame bores and a second final tightening step of grippably engaging a torquing tool onto a portion of the circumference of the tie rod and tightening said opposite threaded ends in the pump frame bores to a predetermined level of foot-pounds of torque.

11. The method as in claim 9 wherein the step of tightening the sleeve-like connectors includes tightening connectors having at least two different lengths.

12. A tie rod and connector sleeve for use in mounting a pump to a fluid cylinder block:

said tie rod comprising an elongate cylindrical-like member having a first end having threading of a diameter less than an adjacent portion of the tie rod thereby forming an annular shoulder, said threading being engageable with a threaded bore in a pump frame, a second end of said tie rod comprising a larger diameter shouldered head for insertion into a bore of a fluid cylinder block; and, said connector being sleeve-like with external threading and an internal passageway for sliding engagement over the tie rod to abut said shouldered head thereof and said external threading being thread engageable to a threaded bore in a fluid cylinder block to clamp the shouldered head therein.

13. The tie rod and connector assembly of claim 12 further including a spacer having a central circular opening capable of being arranged around said annular shoulder.

14. The tie rod and connector assembly of claim 13 wherein said tie rod further includes a circumferential grippable portion.

15. The tie rod and connector assembly of claim 13 wherein the connector includes a head portion for wrench tightening.

16. The tie rod and connector assembly as in claim 13 wherein said shouldered end includes an axial bore.

* * * * *